US011783756B1

(12) United States Patent
Zhou et al.

(10) Patent No.: US 11,783,756 B1
(45) Date of Patent: Oct. 10, 2023

(54) DISPLAY DRIVING CIRCUIT AND DISPLAY DEVICE

(71) Applicant: HKC CORPORATION LIMITED, Shenzhen (CN)

(72) Inventors: Mancheng Zhou, Shenzhen (CN); Haoxuan Zheng, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/342,163

(22) Filed: Jun. 27, 2023

(30) Foreign Application Priority Data

Nov. 3, 2022 (CN) ..... 202211366229.8

(51) Int. Cl.
*G09G 3/20* (2006.01)
*G09G 3/32* (2016.01)

(52) U.S. Cl.
CPC ..... *G09G 3/2096* (2013.01); *G09G 3/32* (2013.01); *G09G 2300/0814* (2013.01); *G09G 2310/0213* (2013.01); *G09G 2310/08* (2013.01); *G09G 2320/0233* (2013.01); *G09G 2320/0242* (2013.01)

(58) Field of Classification Search
CPC ..... G09G 3/32
See application file for complete search history.

(56) References Cited

FOREIGN PATENT DOCUMENTS

| | | | |
|---|---|---|---|
| CN | 1710636 | 12/2005 | |
| CN | 103943066 | 7/2014 | |
| CN | 104091568 | 10/2014 | |
| CN | 113450701 | 9/2021 | |
| CN | 113450701 A * | 9/2021 | ..... G09G 3/32 |
| CN | 113643658 | 11/2021 | |
| CN | 115132129 | 9/2022 | |
| JP | H0667622 | 3/1994 | |

OTHER PUBLICATIONS

CN113450701A Machine Translation (Year: 2023).*
CNIPA, Notification to Grant Patent Right for Invention for CN Application No. 202211366229.8, dated Dec. 26, 2022.
CNIPA, First Office Action for CN Application No. 202211366229.8, dated Dec. 8, 2022.

* cited by examiner

*Primary Examiner* — Gustavo Polo
(74) *Attorney, Agent, or Firm* — Hodgson Russ LLP

(57) ABSTRACT

The display driving circuit includes: a first timing controller, a second timing controller and a selector circuit having a first signal receiving end connected to the first timing controller and receiving a level signal therefrom, a second signal receiving end connected to the second timing controller and receiving a level signal therefrom, a data connection end connected to a data line and output a level signal thereon to the data line, and a reference voltage end. The selector circuit is configured to choose to, in a row scanning stage, control the reference voltage end and the data connection end to be connected in response to the level signal from the first timing controller; and at least choose to, in a two-adjacent-row scanning gap stage, control them to be connected in response to the level signal from the second timing controller.

17 Claims, 4 Drawing Sheets

DISPLAY DRIVING CIRCUIT AND DISPLAY DEVICE

CROSS-REFERENCE TO RELATED APPLICATIONS

This application claims priority to Chinese Patent Application 202211366229.8, filed Nov. 3, 2022, the entire disclosure of which is incorporated herein by reference.

TECHNICAL FIELD

The present disclosure belongs to the field of display technology, and particularly relates to a pixel driving circuit and a display device.

BACKGROUND

With the development of small spacings, LED (Light-Emitting Diode) display screens have put forward higher requirements for row driving, from row switching of pure P-type MOSFETs (Metal-Oxide Semiconductor Field Effect Transistors) to multifunctional row driving with higher integration level and better functionality.

SUMMARY

There are provided a display driving circuit and a display device, according to embodiments of the present disclosure. The technical solution is as below:

A first aspect of the present disclosure provides a display driving circuit, including:

a first timing controller;

a second timing controller; and at least one selector circuit having a first signal receiving end, a second signal receiving end, a data connection end, and a reference voltage end, wherein the first signal receiving end is connected to the first timing controller and configured to receive a level signal output by the first timing controller; the second signal receiving end is connected to the second timing controller and configured to receive a level signal output by the second timing controller; the data connection end is connected to a data line and configured to output a level signal thereon to the data line;

the selector circuit is configured to choose to, in a row scanning stage, control the reference voltage end and the data connection end to be connected to each other in response to the level signal output by the first timing controller; and the selector circuit is configured to at least choose to, in a two-adjacent-row scanning gap stage, control the reference voltage end and the data connection end to be connected to each other in response to the level signal output by the second timing controller.

According to a second aspect of the present disclosure, there is provided a display device, including a display panel located in a display area, a scan driving circuit located in a non-display area, and any one of the display driving circuits described above, wherein the display panel includes a plurality of arrayed light-emitting pixels, a plurality of columns of data lines, and a plurality of rows of scan lines, first electrodes of the light-emitting pixels are connected to the scan lines, the scan lines are connected to the scan driving circuit, second electrodes of the light-emitting pixels are connected to the data lines, and the data lines are connected to data connection ends of the display driving circuit.

Other features and advantages of the present disclosure will become apparent through the detailed description below, or partially learned through the practice of the present disclosure.

It should be understood that the general description above and the detailed description below are only exemplary and explanatory, and cannot limit the present disclosure.

BRIEF DESCRIPTION OF THE DRAWINGS

The accompanying drawings herein are incorporated into the specification, constitute part of this specification, show the embodiments consistent with the present disclosure, and are used together with the specification to explain the principle of the present disclosure. Apparently, the accompanying drawings in the description below merely illustrate some embodiments of the present disclosure. Those of ordinary skill in the art may also derive other accompanying drawings from these accompanying drawings without creative efforts.

DETAILED DESCRIPTION OF THE EMBODIMENTS

The exemplary embodiments will now be described more fully with reference to the accompanying drawings. However, the exemplary embodiments can be implemented in various forms and should not be understood to be limited to the examples elaborated herein; and rather, these embodiments are provided so that the present disclosure will be more comprehensive and complete, and the concept of the exemplary embodiments will be fully communicated to those skilled in the art.

In the present disclosure, the terms such as "first" and "second" are only used for descriptive purposes, and cannot be construed as indicating or implying relative importance or implying the number of technical features indicated. Thus, the features defined with "first" and "second" may explicitly or implicitly include one or more of the features. In the description of the present disclosure, "a plurality of" means two or more, unless otherwise expressly and specifically defined.

In addition, the features, structures, or characteristics described may be combined in any suitable way in one or more embodiments. In the description below, many specific details are provided to give a full understanding of the embodiments of the present disclosure. However, those skilled in the art will realize that the technical solution of the present disclosure may be practiced without one or more specific details, or other methods, components, devices, steps, etc. may be employed. In other cases, the well-known methods, devices, implementations, or operations are not shown or described in detail to avoid blurring various aspects of the present disclosure.

Embodiment 1

Figure 1:
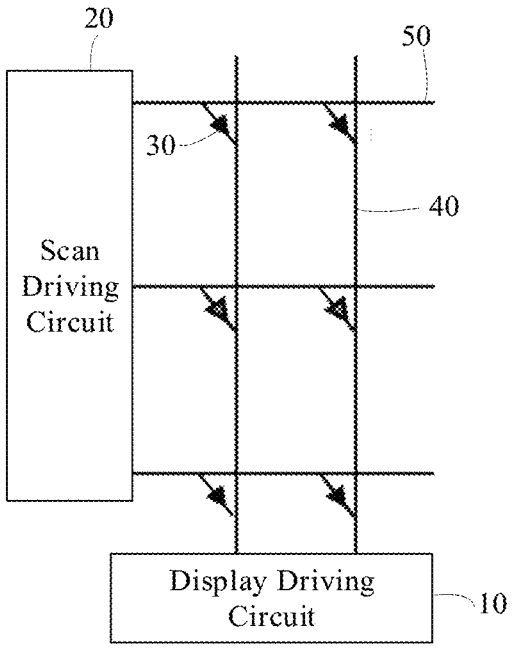
FIG. 1 shows a schematic structural diagram of a display device described in the present disclosure.

The present disclosure provides a display device. As shown in FIG. 1, the display device may include a display driving circuit 10, a scan driving circuit 20, and a display panel. The display panel may include a plurality of arrayed light-emitting pixels 30, a plurality of columns of data lines 40, and a plurality of rows of scan lines 50, wherein the scan lines 50 are connected to the scan driving circuit 20, the data lines 40 are connected to data connection ends of the display driving circuit 10, and the light-emitting pixels 30 have first electrodes connected to the scan lines 50 and second electrodes connected to the data lines 40.

The scan driving circuit 20 writes a first voltage into the first electrodes of the light-emitting pixels 30 through the scan lines 50. The display driving circuit 10 writes a second voltage into the second electrodes of the light-emitting pixels 30 through the data lines 40. When a difference between the first voltage and the second voltage at two ends of the light-emitting pixel 30 is greater than a threshold voltage of the light-emitting pixel 30, the light-emitting pixel 30 may emit light. When the difference between the first voltage and the second voltage of the light-emitting pixel 30 is less than the threshold voltage of the light-emitting pixel 30, the light-emitting pixel 30 does not emit light.

For example, the display panel in the embodiment of the present disclosure may be an OLED display, a Mini-LED display, or a Micro-LED display. In other words, the light-emitting pixels 30 may be light-emitting diodes (LEDs for short).

It should be understood that the light-emitting diodes have first electrodes being anodes and second electrodes being cathodes, wherein each of the rows of scan lines 50 is correspondingly connected to the anodes of the light-emitting diodes in a row, and each of the columns of data lines 40 is correspondingly connected to the cathodes of the light-emitting diodes in a column.

When a data signal Row of a control row in the scan driving circuit 20 is low, a voltage (i.e. an anode voltage of the LEDs) on the scan line 50 will be pulled up, and output data (which may be understood as a cathode voltage of the LEDs) Out of the display driving circuit that is received from the data line 40 will be displayed. A transistor, connected to the scan line 50, in the scan driving circuit 20 in FIG. 2 may be a P-type transistor, and therefore is turned on in response to a low-level signal, to pull up the voltage on the corresponding scan line 50.

Figure 2:
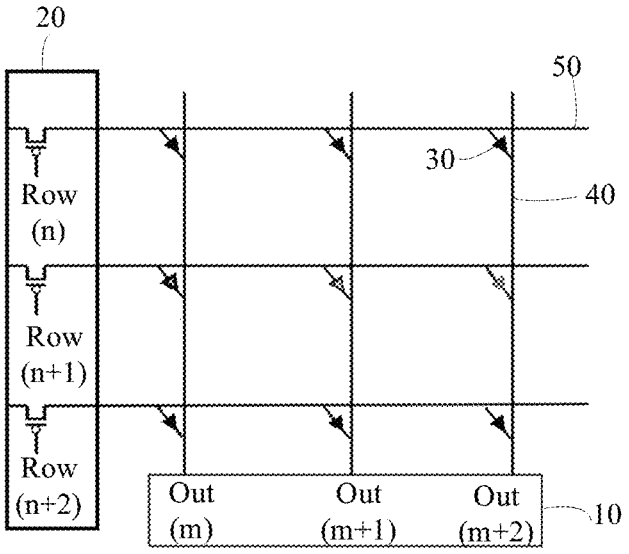
FIG. 2 shows a schematic diagram of a connection relationship among a scan driving circuit, a display driving circuit, data lines, scan lines, and light-emitting pixels described in the present disclosure.
Figure 3:
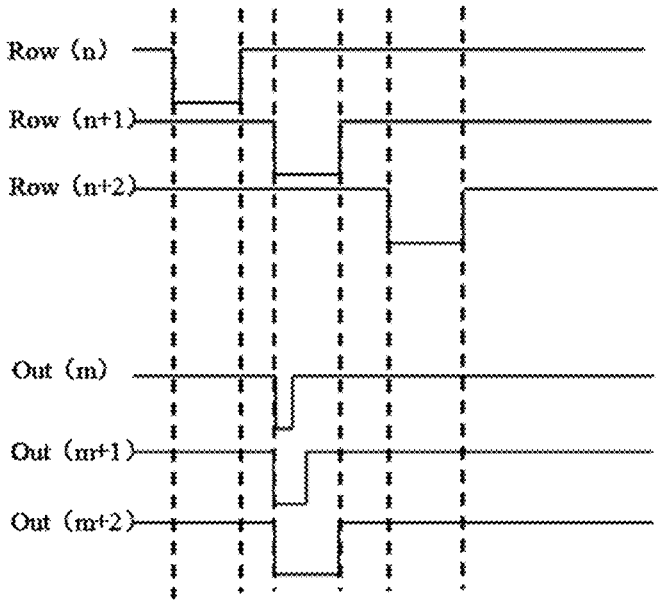
FIG. 3 shows a timing diagram of the display device shown in FIG. 2.

As shown in FIG. 2 and FIG. 3, a control end of a transistor, located on an nth row of scan line, in the scan driving circuit 20 responds to a data signal Row(n), a control end of a transistor, located on an $(n+1)^{th}$ row of scan line, in the scan driving circuit 20 responds to a data signal Row (n+1), and a control end of a transistor, located on an $(n+2)^{th}$ row of scan line, in the scan driving circuit 20 responds to a data signal Row(n+2); and a data signal written by the display driving circuit 10 to an $m^{th}$ column of data line is Out(m), a data signal written by the display driving circuit 10 to an $(m+1)^{th}$ column of data line is Out(m+1), and a data signal written by the display driving circuit 10 to an $(m+2)^{th}$ column of data line is Out(m+2), wherein if widths of a data signal Out being low are different, different LED light brightness will be obtained, and this width is controlled by a PWM (Pulse Width Modulation) signal, while a span of PWM is determined by a period of GCLK (Grayscale Clock).

When the data signal Row(n+1) of the control row in the scan driving circuit 20 is low, a voltage on the $(n+1)^{th}$ row of scan line will be pulled up. In this stage, the $m^{th}$ column of data line, the $(m+1)^{th}$ column of data line, and the $(m+2)^{th}$ column of data line correspondingly receive a low-level signal of the data signal Out(m), a low-level signal of the data signal Out(m+1), and a low-level signal of the data signal Out(m+2), so that $m^{th}$, $(m+2)^{th}$, and $(m+2)^{th}$ LEDs in the $(n+1)^{th}$ row emit light. As shown in FIG. 3, widths of the low-level signals of the data signal Out(m), the data signal Out(m+1), and the data signal Out(m+2) increase sequentially, that is, light-emitting time of the $m^{th}$, $(m+1)^{th}$, and $(m+2)^{th}$ LEDs in the $(n+1)^{th}$ row is prolonged sequentially. In other words, the widths of the low-level signals of the data signal Out is positively correlated with the light-emitting time of the LEDs.

At low brightness (low grayscale or low gray level), the LEDs emit light for a short time, and a current in a discharge path of parasitic capacitors is constant, resulting in a smaller proportion of the current flowing through the LEDs to cause color deviation of the LEDs. For example, if the proportion of current flowing through a red LED is less affected, the whole LED tends to be red; if the proportion of the current flowing through a blue LED is less affected, the whole LED tends to be blue; and if the proportion of the current flowing through a green LED is less affected, the whole LED tends to be green.

At low grayscale, the time for turning on PWM is shorter, the total current flowing through the LEDs is lower, and the current at the data connection end (a port connected to the data line 40) of the display driving circuit 10 is a sum of the current flowing through the LEDs and the current of the parasitic capacitor on the data line 40, so that compared with high grayscale, the low grayscale has different current proportion than the high grayscale, which leads to different effects of the parasitic capacitor on R (red), G (green) and B (blue) LEDs, and the current on the parasitic capacitor at low grayscale (generally referring to grayscale of 0-31) will obviously affect display to cause color deviation. The current passing through the data connection end of the display driving circuit 10 does not completely passes through the LEDs and also includes the charge on the parasitic capacitor of the data line 40, in other words, the root cause for color deviation at low grayscale is that the current required for the LED to emit light is lower than the current flowing through the data connection end of the display driving circuit 10, that is, the actual brightness of the LEDs has not reached its original brightness.

To improve this situation, the aforementioned display driving circuit 10 is improved in the embodiment of the present disclosure. Specifically, as shown in FIG. 4, the display driving circuit 10 in the embodiment of the present disclosure may include a first timing controller 101, a second timing controller 102, and a selector circuit 103.

The first timing controller 101 is configured to control, in a normal display stage (the row scanning stage), the light-emitting pixels 30 to emit light; and the second timing controller 102 is configured to control, in the two-adjacent-row scanning gap stage, charge of the parasitic capacitors on the data lines 40 to be released.

Figure 4:
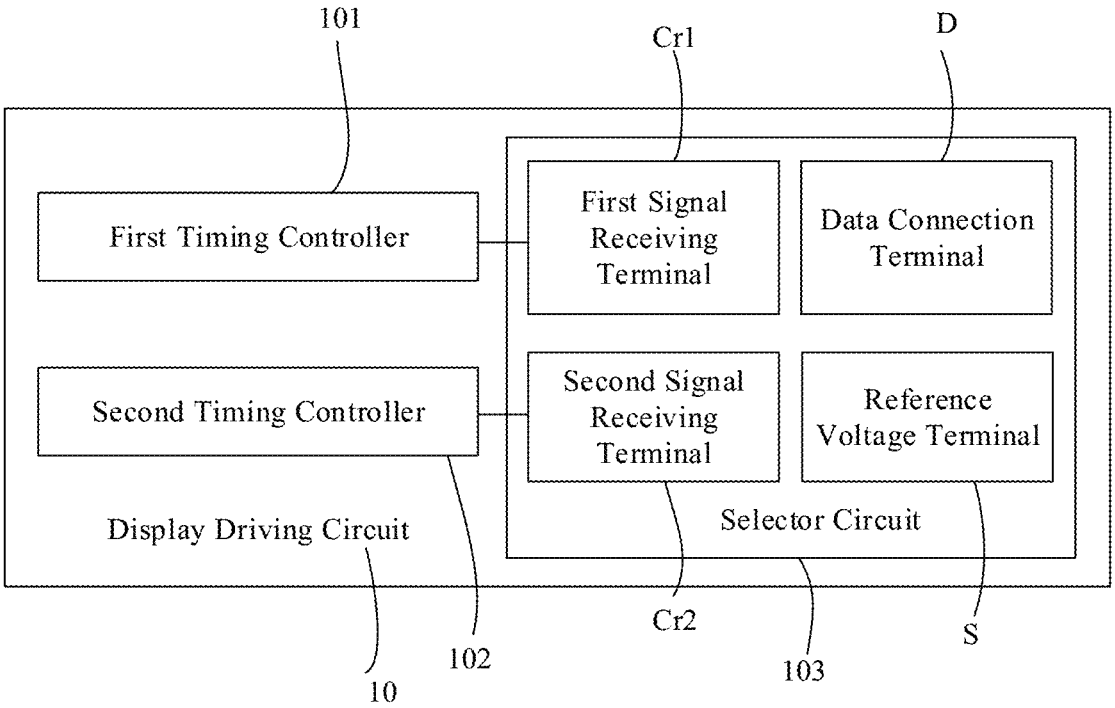
FIG. 4 shows a structural block diagram of a display driving circuit described in Embodiment 1 of the present disclosure.

Specifically, as shown in FIG. 4, the selector circuit 103 has a first signal receiving end Cr1, a second signal receiving end Cr2, a data connection end D, and a reference voltage end S, wherein the first signal receiving end Cr1 is connected to the first timing controller 101 and configured to receive a level signal output by the first timing controller 101; the second signal receiving end Cr2 is connected to the second timing controller 102 and configured to receive a level signal output by the second timing controller 102; and the data connection end D is connected to the data line 40 and configured to output a level signal thereon to the data line 40.

Figure 5:
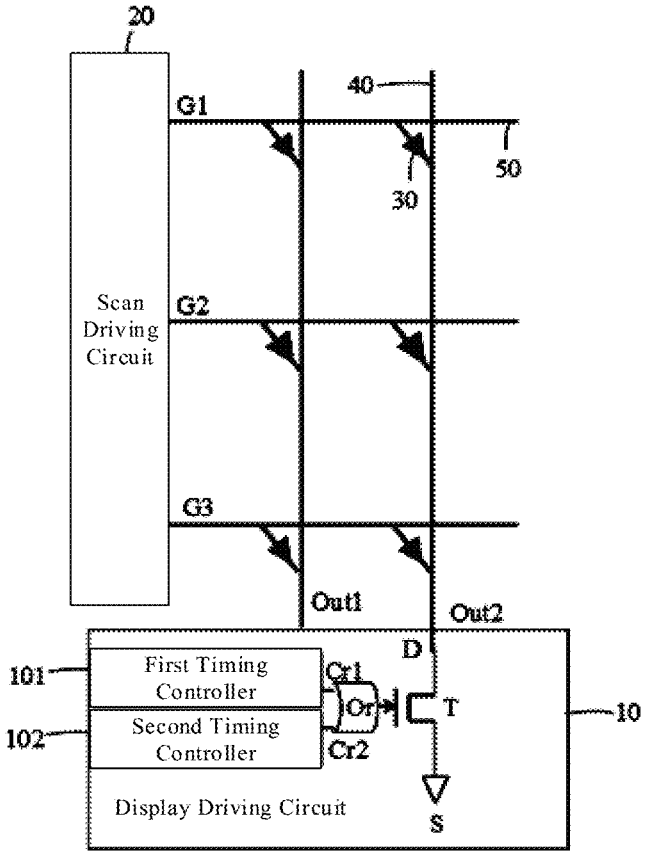
FIG. 5 shows a schematic structural diagram of a display device described in Embodiment 1 of the present disclosure.

It should be understood that the display driving circuit 10 may include a plurality of selection circuits 103, and the data connection end D of each of the selector circuits 103 is correspondingly connected to one data line 40. FIG. 5 only shows a schematic diagram of connection between one selector circuit 103 and one data line 40. It should be noted that other data lines 40 may also be connected to one selector circuit 103 in this way. In addition, in FIG. 5, G1, G2, and G3 are signals output by the scan driving circuit 20 to corresponding rows, while Out1 and Out2 are signals output by the display driving circuit 10 to corresponding columns.

Figure 6:
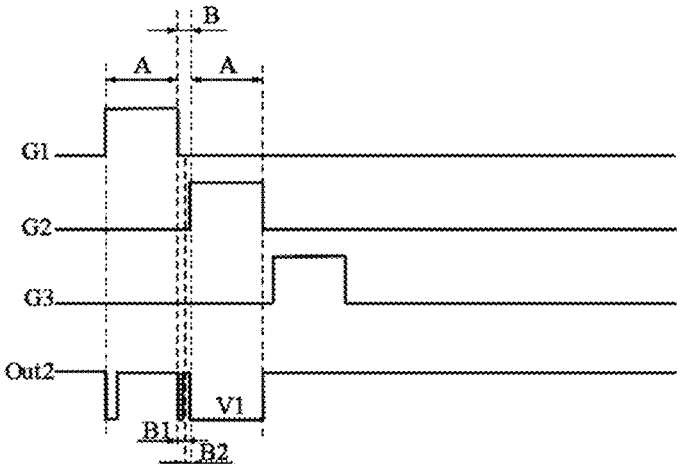
FIG. 6 shows a timing diagram of the display device shown in FIG. 5.

As shown in FIG. 5 and FIG. 6, the selector circuit 103 is configured to choose to, in the row scanning stage (the normal display stage) A, control the reference voltage end S and the data connection end D to be connected to each other in response to the level signal output by the first timing controller 101, so that a voltage V1 on the reference voltage end S is written into the second electrode of the light-emitting pixel 30 through the data connection end D, and thus a voltage difference between the first electrode and the second electrode of the light-emitting pixel 30 is greater than the threshold voltage of the light-emitting pixel 30, allowing the light-emitting pixel 30 to emit light for display. It should be understood that the threshold voltage of the light-emitting pixel 30 is generally greater than 0.

For example, as shown in FIG. 6, in the row scanning stage A, a voltage received by the corresponding row of scan line 50 is a high-level voltage, and a voltage (such as Out2) provided by the reference voltage end S to the data line 40 is a low-level voltage, so that a voltage difference greater than the threshold voltage of the light-emitting pixel is formed at two ends of the light-emitting pixel 30, thereby implementing normal light-emitting display.

The selector circuit 103 is configured to at least choose to, in the two-adjacent-row scanning gap stage B, control the reference voltage end S and the data connection end D to be connected to each other in response to the level signal output by the second timing controller 102, so that the voltage on the reference voltage end S is written into the second electrode of the light-emitting pixel 30 through the data connection end D. During a stage B1 in FIG. 6, charge of a parasitic capacitor on the data line 40 is released in advance before this column of light-emitting pixels (i.e., the column of light-emitting pixels driven by this data line 40) emit light, that is, the charge is released in the two-adjacent-row scanning gap stage B, thereby ensuring that the total current of the data connection end D is equal to or basically close to the current passing through the light-emitting pixels 30. In other words, it is ensured that the current for this column of light-emitting pixels 30 to emit light basically completely passes through the data connection end D, so that the problem of color deviation of the light-emitting pixels 30 at low grayscale may be solved and the display uniformity may be improved.

It should be understood that to ensure that the light-emitting pixel 30 does not emit light in the two-adjacent-row scanning gap stage B, a difference between the voltage received by the scan line 50 and the reference voltage provided by the reference voltage end S should be less than the threshold voltage of the light-emitting pixel 30, so as to avoid affecting normal data display.

For example, in the two-adjacent-row scanning gap stage B, G2 is at a low level, which means that the voltage received by the corresponding row of scan line 50 is a low-level voltage. In this stage, the voltage of Out2 in the stage B1 is a low-level voltage provided by the reference voltage end S to the corresponding data line 40, and the electric potential thereof in a stage B2 is a blanking voltage corresponding to the data line 40, so that the voltage difference between the two electrodes of the light-emitting pixel 30 is equal to 0 (in the stage B1) or less than 0 (in the stage B2). Because the threshold voltage of the light-emitting pixel is greater than 0, the light-emitting pixel 30 does not emit light in the two-adjacent-row scanning gap stage B.

In addition, it should be noted that the two-adjacent-row scanning gap stage B in this embodiment refers to a stage after nth row scanning and before $(n+1)^{th}$ row scanning.

In an optional embodiment, the selector circuit 103 is configured to choose to, during part of time periods (such as a time period B1 in FIG. 6) in the two-adjacent-row scanning gap stage B, control the reference voltage end S and the data connection end D in response to the level signal output by the second timing controller 102. In other words, charge release time of the parasitic capacitor on the data line 40 is shorter than two-adjacent-row scanning gap time, so that compared with a solution of implementing charge release with the complete two-adjacent-row scanning gap time, this solution may not only implement charge release of the parasitic capacitor on the data line 40 to improve color deviation of the light-emitting pixel, but also reduce the control accuracy, to reduce lightening by mistake.

Further, the two-adjacent-row scanning gap stage B may be divided into at least two time periods, for example, as shown in FIG. 6, the two-adjacent-row scanning gap stage B includes at least a first time period B1 and a second time period B2 that are set in sequence. The selector circuit 103 is configured to choose to, in the first time period B1, control the reference voltage end S and the data connection end D to be connected to each other in response to a first level signal output by the second timing controller 102. In this case, the first time period B1 corresponds to a stage of releasing the charge of the parasitic capacitor on the data line 40. The selector circuit 103 is further configured to choose to, in the second time period B2, control the reference voltage end S and the data connection end D to be disconnected from each other in response to a second level signal output by the second timing controller 102. In this case, the voltage on the data line 40 is the blanking voltage, and the second time period is a transition time period between the charge release stage and a next-row light-emitting stage. Such a design ensures that the release of the charge on the data line 40 is completed as early as possible between scanning gaps of two adjacent rows, to avoid the color deviation caused by incomplete charge release.

It should be understood that the level signals output by the second timing controller 102 during the first time period B1 and the second time period B2 in the two-adjacent-row scanning gap stage B are different, that is, one of the first level signal output by the second timing controller 102 in the first time period B1 and the second level signal output by the second timing controller in the second time period B2 is a high-level signal, while the other of the first level signal output by the second timing controller in the first time period and the second level signal output by the second timing controller in the second time period is a low-level signal, which may be selected according to a specific structure of the selector circuit 103.

It should be understood that a control signal output by the first timing controller 101 is not affected by the second timing controller 102, and only needs to be controlled to be output according to specific display requirements. In the normal row scanning display stage (i.e. the row scanning stage), the selector circuit 103 will normally write the reference voltage of the reference voltage end S into the data line 40 through the data connection end D in response to the level signal output by the first timing controller 101.

In a specific embodiment, the second timing controller 102 can adjust an output duration of the first level signal in the two-adjacent-row scanning gap stage B based on display parameter information, that is, a duration of the first time period B1 in the two-adjacent-row scanning gap stage B is adjusted, to adjust a charge release duration of the parasitic capacitor on the data line 40. It should be noted that this display parameter information may include parameters such as color deviation.

For example, when there is still color deviation in a detected display picture, it may be that the charge of the parasitic capacitor on the data line 40 has not been fully released, and the second timing controller 102 prolongs the output duration of the first level signal in the two-adjacent-row scanning gap stage B, that is, the duration of the first time period B1 in the two-adjacent-row scanning gap stage B is prolonged, so that the charge of the parasitic capacitor on the data line 40 is fully released, thereby improving the color deviation.

In the embodiment of the present disclosure, as shown in FIG. 5, the selector circuit 103 includes an OR gate Or and a switching transistor T, wherein the OR gate Or has the above-mentioned first signal receiving end Cr1, the above-mentioned second signal receiving end Cr2, and a signal output end; and the switching transistor T has a control end connected to the signal output end of the OR gate Or, a first end connected to the data connection end D, and a second end connected to the reference voltage end S. This selector circuit 103 has a simple structure, which facilitates circuit design, saves space, and reduces costs.

For example, this switching transistor T may be an N-type transistor. In the two-adjacent-row scanning gap stage B, if the level signal output by the first timing controller 101 to the first signal receiving end Cr1 is a low-level signal, and the level signal output by the second timing controller 102 to the second signal receiving end Cr2 is a high-level signal, a control signal output by the OR gate Or to the switching transistor T is a high-level signal, so that the first end and the second end of the switching transistor T are connected to each other, that is, the reference voltage end S is connected to the data connection end D, and thus the reference voltage output by the reference voltage end S is written into the data line 40 through the data connection end D, thereby implementing charge release of the parasitic capacitor on the data line 40.

Specifically, when the two-adjacent-row scanning gap stage B includes the above-mentioned first time period B1 and second time period B2, the first level signal output by the second timing controller 102 in the first time period B1 is a high-level signal, and the second level signal output by the second timing controller in the second time period B2 is a low-level signal.

It should be understood that in the row scanning stage A, the level signal output by the first timing controller 101 is a high-level signal, and the level signal output by the second timing controller 102 is not limited and may be a high-level signal or a low-level signal.

The switching transistor T is not limited to the N-type transistor and may also be a P-type transistor, and it is only needed to correspondingly adjust the level signals output by the first timing controller 101 and the second timing controller 102. There is no excessive limitation herein.

In this embodiment, a reference voltage provided by the reference voltage end S in the row scanning stage A may be equal to a reference voltage provided by the reference voltage end in the two-adjacent-row scanning gap stage. As shown in FIG. 5 and FIG. 6, the structure is simplified and the cost is reduced.

Embodiment 2

There is a main difference between Embodiment 2 and Embodiment 1 that specific structures of the selector circuit 103 are different. Other structures may refer to those in Embodiment 1 and will not be repeated herein.

Figure 7:
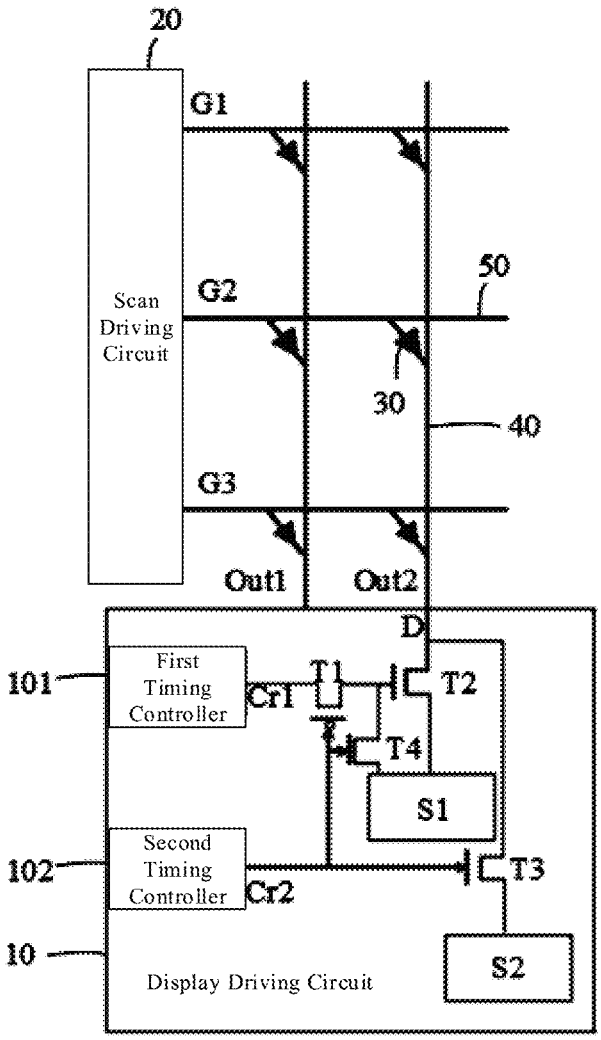
FIG. 7 shows a schematic structural diagram of a display device described in Embodiment 2 of the present disclosure.

In this embodiment, as shown in FIG. 7, the reference voltage end includes a first reference voltage end S1 and a second reference voltage end S2; and in addition to including the above-mentioned first signal receiving end Cr1, second signal receiving end Cr2, data connection end D, and reference voltage end S, the selector circuit 103 may further include a first transistor T1, a second transistor T2, a third transistor T3, and a fourth transistor T4.

A control end of the first transistor T1, a control end of the third transistor T3, and a control end of the fourth transistor T4 are connected to the second signal receiving end Cr2; the first transistor T1 has a first end connected to the first signal receiving end Cr1 and a second end connected to a control end of the second transistor T2; the second transistor T2 has a first end connected to the data connection end D and a second end connected to the first reference voltage end S1; the third transistor T3 has a first end connected to the data connection end D and a second end connected to the second reference voltage end S2; and the fourth transistor T4 has a first end connected to the control end of the second transistor T2 and a second end connected to the first reference voltage end S1.

In this embodiment, the first transistor T1 is a first-type transistor, each of the second transistor T2, the third transistor T3, and the fourth transistor T4 is a second-type transistor, and one of the first-type transistor and the second-type transistor is a P-type transistor, while the other of the first-type transistor and the second-type transistor is an N-type transistor.

For example, the first switching transistor T1 is a P-type transistor, the second switching transistor T2, the third switching transistor T3, and the fourth switching transistor T4 are N-type switching transistors.

Figure 8:
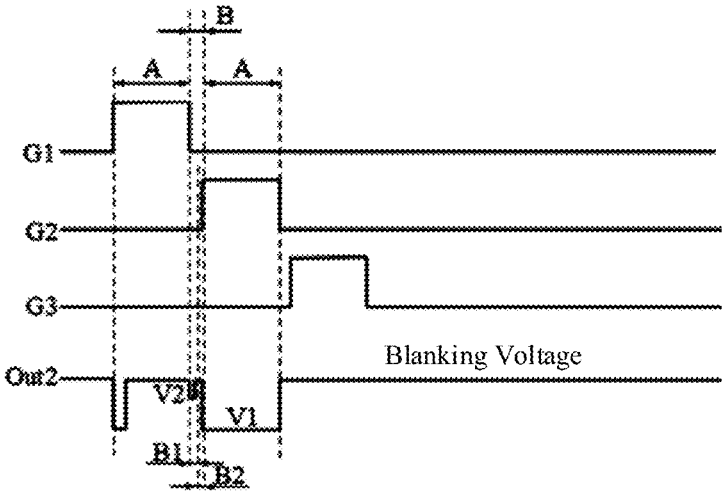
FIG. 8 shows a timing diagram of the display device shown in FIG. 7.

In the normal display stage (i.e. in the row scanning stage A), the level signal output by the second timing controller 102 to the second signal receiving end Cr2 is a low-level signal. In this case, the third transistor T3 and the fourth transistor T4 are turned off, the first transistor T1 is turned on, and the first timing controller 101 outputs a level signal to the first signal receiving end Cr1 to control turn-on or turn-off of the second transistor T2. When the level signal output by the first timing controller 101 to the first signal receiving end Cr1 is a high-level signal, the second transistor T2 is turned on, and the first reference voltage end S1 writes its reference voltage into the data line 40 through the data connection end D, that is, the voltage on the data line 40 is equal to the reference voltage (V1 as shown in FIG. 8) at the first reference voltage end S1. When the level signal output by the first timing controller 101 to the first signal receiving end Cr1 is a low-level signal, the second transistor T2 is turned off, and the voltage of the data line 40 is equal to a column default voltage (which may be understood as the blanking voltage).

During a time period of switching between rows (i.e., the two-adjacent-row scanning gap stage B), the level signal output by the second timing controller 102 to the second signal receiving end Cr2 is a high-level signal. In this case, the third transistor T3 and the fourth transistor T4 are turned on, and the first transistor T1 is turned off. Because each of voltages of a gate and a source (the control end and the second end) of the second transistor T2 is the voltage provided by the first reference voltage end S1, that is, a voltage difference Vgs between the gate and the source of the second transistor T2 is equal to 0, the voltage difference between the gate and the source of the second transistor is less than a threshold voltage Vth of the second transistor T2, so that the second transistor T2 is turned off. In this case, the voltage on the data line 40 is equal to the reference voltage (V2 as shown in FIG. 8) provided by the second reference voltage end S2. It should be understood that the reference voltage provided by the second reference voltage end S2 and written into the data line 40 does not affect the normal display stage.

The selector circuit 103 in this embodiment adopts this design, so that the reference voltages written into the data line 40 in the row scanning stage A and the two-adjacent-row scanning gap stage B may be different or same, and may be adjusted and matched according to the actual situation, making it more flexible.

For example, in this embodiment, the voltage provided by the first reference voltage end S1 is not equal to the voltage provided by the second reference voltage end S2. Specifically, the voltage V2 provided by the second reference voltage end S2 is between the blanking voltage of the data line 40 and the reference voltage V1 provided by the first reference voltage end S1, so that the light-emitting pixels 30 may be protected while the consumption is reduced.

According to the solution of the present disclosure, the selector circuit connects, in the two-adjacent-row scanning gap stage, the reference voltage end to the data connection end by using the signal output by the second timing controller, without affecting normal display, that is, in the two-adjacent-row scanning gap stage, the reference voltage of the reference voltage end is written into the data line, so that charge of a parasitic capacitor on the data line is released in advance before this column of light-emitting pixels (i.e., the column of light-emitting pixels driven by this data line) emit light, thereby ensuring that the total current of the data connection end is equal to or basically close to the current passing through the light-emitting pixels. In other words, it is ensured that the current for this column of light-emitting pixels to emit light basically completely passes through the data connection end, so that the problem of color deviation of the light-emitting pixels at low grayscale may be solved and the display uniformity may be improved.

It should be understood that to ensure that the light-emitting pixel does not emit light in the two-adjacent-row scanning gap stage, a difference between a voltage provided by the scan line and the reference voltage provided by the reference voltage end is less than a threshold voltage of the light-emitting pixel, so as to avoid affecting normal data display.

In the description of this specification, the description with reference to the terms such as "some embodiments" and "examples" means that the specific features, structures, materials or characteristics described in combination with the embodiments or examples are included in at least one embodiment or example of the present disclosure. In this specification, the schematic representations of the above terms do not necessarily refer to the same embodiments or examples. Moreover, the specific features, structures, materials or characteristics described may be combined in a suitable way in any one or more embodiments or examples. In addition, those skilled in the art may combine different embodiments or examples described in this specification and features of different embodiments or examples, without mutual contradiction.

Although the embodiments of the present disclosure have been shown and described above, it may be understood that the above embodiments are exemplary and cannot be understood as a limitation to the present disclosure. Those of ordinary skill in the art may make changes, modifications, substitutions, and modifications to the above embodiments within the scope of the present disclosure. Therefore, any changes or modifications made in accordance with the claims and specification of the present disclosure should fall within the scope of the present disclosure.

What is claimed is:

1. A display driving circuit, comprising:

a first timing controller;

a second timing controller; and at least one selector circuit having a first signal receiving end, a second signal receiving end, a data connection end, and a reference voltage end, wherein the first signal receiving end is connected to the first timing controller and configured to receive a level signal output by the first timing controller; the second signal receiving end is connected to the second timing controller and configured to receive a level signal output by the second timing controller; the data connection end is connected to a data line and configured to output a level signal on the data connection end to the data line;

wherein the at least one selector circuit comprises an OR gate and a switching transistor, the OR gate has the first signal receiving end, the second signal receiving end, and a signal output end, and the switching transistor has a control end connected to the signal output end, a first end connected to the data connection end, and a second end connected to the reference voltage end, wherein the switching transistor is an N-type transistor;

wherein the at least one selector circuit is configured to choose to, in a row scanning stage, control the reference voltage end and the data connection end to be connected to each other in response to a high level signal output by the first timing controller; and in a two-adjacent-row scanning gap stage, the level signal output by the first timing controller to the first signal receiving end is a low level signal and the at least one selector circuit is configured to at least choose to, in the two-adjacent-row scanning gap stage, control the reference voltage end and the data connection end to be connected to each other in response to the high level signal output by the second timing controller, so that charge of a parasitic capacitor on the data line is released in advance before this column of light-emitting pixels emit light.

2. The display driving circuit according to claim 1, wherein the at least one selector circuit is configured to choose to, during part of time periods in the two-adjacent-row scanning gap stage, control the reference voltage end and the data connection end to be connected to each other in response to the high level signal output by the second timing controller.

3. The display driving circuit according to claim 2, wherein the two-adjacent-row scanning gap stage comprises a first time period and a second time period that are set in sequence;

wherein the at least one selector circuit is configured to choose to, in the first time period, control the reference voltage end and the data connection end to be connected to each other in response to the high level signal output by the second timing controller; the at least one selector circuit is configured to choose to, in the second time period, control the reference voltage end and the data connection end to be disconnected from each other in response to a low level signal output by the second timing controller.

4. The display driving circuit according to claim 3, wherein the second timing controller is capable of adjusting a duration of the first time period based on display parameter information.

5. The display driving circuit according to claim 4, wherein when there is still color deviation in a detected display picture, the second timing controller prolongs an output duration of a first level signal in the two-adjacent-row scanning gap stage.

6. A display driving circuit, comprising:

a first timing controller;

a second timing controller; and at least one selector circuit having a first signal receiving end, a second signal receiving end, a data connection end, and a reference voltage end, wherein the first signal receiving end is connected to the first timing controller and configured to receive a level signal output by the first timing controller; the second signal receiving end is connected to the second timing controller and configured to receive a level signal output by the second timing controller; the data connection end is connected to a data line and configured to output a level signal on the data connection end to the data line;

wherein the at least one selector circuit comprises a first transistor, a second transistor, a third transistor, and a fourth transistor, the first transistor is a P-type transistor, while each of the second transistor to the fourth transistor is an N-type transistor;

wherein a control end of the first transistor, a control end of the third transistor, and a control end of the fourth transistor are connected to the second signal receiving end;

wherein the first transistor has a first end connected to the first signal receiving end and a second end connected to a control end of the second transistor;

wherein the second transistor has a first end connected to the data connection end and a second end connected to a first reference voltage end;

wherein the third transistor has a first end connected to the data connection end and a second end connected to a second reference voltage end; and wherein the fourth transistor has a first end connected to the control end of the second transistor and a second end connected to the first reference voltage end;

wherein the at least one selector circuit is configured to choose to, in a row scanning stage, control the first reference voltage end and the data connection end to be connected to each other in response to a high level signal output by the first timing controller and a low level signal output by the second timing controller; and the at least one selector circuit is configured to at least choose to, in a two-adjacent-row scanning gap stage, control the second reference voltage end and the data connection end to be connected to each other in response to the high level signal output by the second timing controller, so that charge of a parasitic capacitor on the data line is released in advance before this column of light-emitting pixels emit light.

7. The display driving circuit according to claim 6, wherein a voltage provided by the first reference voltage end is not equal to a voltage provided by the second reference voltage end, and the voltage provided by the second reference voltage end is between a blanking voltage of the data line and a reference voltage provided by the first reference voltage end.

8. The display driving circuit according to claim 6, wherein the at least one selector circuit is configured to choose to, during part of time periods in the two-adjacent-row scanning gap stage, control the second reference voltage end and the data connection end to be connected to each other in response to the high level signal output by the second timing controller.

9. The display driving circuit according to claim 8, wherein the two-adjacent-row scanning gap stage comprises a first time period and a second time period that are set in sequence;

wherein the at least one selector circuit is configured to choose to, in the first time period, control the second reference voltage end and the data connection end to be connected to each other in response to the high level signal output by the second timing controller; the at least one selector circuit is configured to choose to, in the second time period, control the second reference voltage end and the data connection end to be disconnected from each other in response to the low level signal output by the second timing controller.

10. The display driving circuit according to claim 9, wherein the second timing controller is capable of adjusting a duration of the first time period based on display parameter information.

11. The display driving circuit according to claim 10, wherein when there is still color deviation in a detected display picture, the second timing controller prolongs an output duration of a first level signal in the two-adjacent-row scanning gap stage.

12. A display device, comprising a display panel, a scan driving circuit, and a display driving circuit, wherein the display driving circuit comprising:

a first timing controller;

a second timing controller; and at least one selector circuit having a first signal receiving end, a second signal receiving end, a data connection end, and a reference voltage end, wherein the first signal receiving end is connected to the first timing controller and configured to receive a level signal output by the first timing controller; the second signal receiving end is connected to the second timing controller and configured to receive a level signal output by the second timing controller; the data connection end is connected to a data line and configured to output a level signal on the data connection end to the data line;

wherein the at least one selector circuit comprises an OR gate and a switching transistor, the OR gate has the first signal receiving end, the second signal receiving end, and a signal output end, and the switching transistor has a control end connected to the signal output end, a first end connected to the data connection end, and a second end connected to the reference voltage end, wherein the switching transistor is an N-type transistor;

wherein the at least one selector circuit is configured to choose to, in a row scanning stage, control the reference voltage end and the data connection end to be connected to each other in response to a high level signal output by the first timing controller; and in a two-adjacent-row scanning gap stage, the level signal output by the first timing controller to the first signal receiving end is a low level signal and the at least one selector circuit is configured to at least choose to, in the two-adjacent-row scanning gap stage, control the reference voltage end and the data connection end to be connected to each other in response to the high level signal output by the second timing controller, so that charge of a parasitic capacitor on the data line is released in advance before this column of light-emitting pixels emit light;

wherein the display panel comprises a plurality of arrayed light-emitting pixels, a plurality of columns of data lines, and a plurality of rows of scan lines, first electrodes of the light-emitting pixels are connected to the scan lines, the scan lines are connected to the scan driving circuit, second electrodes of the light-emitting pixels are connected to the data lines, and the data lines are connected to data connection ends of the display driving circuit.

13. The display device according to claim 12, wherein the light-emitting pixels are light-emitting diodes, the first electrodes are anodes, and the second electrodes are cathodes;

wherein each row of the scan lines is correspondingly connected to the anodes of the light-emitting diodes in a row, and each columns of the data lines is correspondingly connected to the cathodes of the light-emitting diodes in a column.

14. The display device according to claim 12, wherein the at least one selector circuit is configured to choose to, during part of time periods in the two-adjacent-row scanning gap stage, control the reference voltage end and the data connection end to be connected to each other in response to the high level signal output by the second timing controller.

15. The display device according to claim 14, wherein the two-adjacent-row scanning gap stage comprises a first time period and a second time period that are set in sequence;

wherein the at least one selector circuit is configured to choose to, in the first time period, control the reference voltage end and the data connection end to be connected to each other in response to the high level signal output by the second timing controller; the at least one selector circuit is configured to choose to, in the second time period, control the reference voltage end and the data connection end to be disconnected from each other in response to a low level signal output by the second timing controller.

16. The display device according to claim 15, wherein the second timing controller is capable of adjusting a duration of the first time period based on display parameter information.

17. The display device according to claim 16, wherein when there is still color deviation in a detected display picture, the second timing controller prolongs an output duration of a first level signal in the two-adjacent-row scanning gap stage.

* * * * *